US005690344A

United States Patent [19]

Chen

[11] Patent Number: 5,690,344

[45] Date of Patent: Nov. 25, 1997

[54] IN-LINE ROLLER SKATE WITH A SOLE PLATE STRUCTURE

[75] Inventor: Kim Chen, Taichung Hsien, Taiwan

[73] Assignee: Playmaker-Co., Ltd., Taipei, Taiwan

[21] Appl. No.: 589,079

[22] Filed: Jan. 23, 1996

[51] Int. Cl.[6] ..... A63C 17/00

[52] U.S. Cl. ..... 280/11.28; 280/11.22; 280/11.27

[58] Field of Search ..... 280/11.19, 11.22, 280/11.27, 11.28, 11.3; 36/115

[56] References Cited

U.S. PATENT DOCUMENTS

| | | | |
|---|---|---|---|
| 5,190,301 | 3/1993 | Malewicz | 280/11.22 |
| 5,330,208 | 7/1994 | Charron et al. | 280/11.22 |
| 5,342,071 | 8/1994 | Soo | 280/11.28 |
| 5,484,149 | 1/1996 | Lee | 280/11.27 |
| 5,536,025 | 7/1996 | Landay | 280/11.28 |

*Primary Examiner*—Brian L. Johnson
*Assistant Examiner*—Min Yu
*Attorney, Agent, or Firm*—Donald C. Casey

[57] ABSTRACT

An in-line roller skate having an improved sole plate structure includes a boot with an outer sole provided with a plurality of downwardly extending projections. Each projection is provided with a vertically oriented, elongated slot for receiving a bushing of an elastic plastic material for absorbing shock, and at least two pairs of mounting plates for clamping rollers between each pair pivotally-mounted to the corresponding projections. Each pair of mounting pairs secures two rollers at either end thereof. The mounting plates are arranged to be pairs of two and each pair of mounting plates is independently mounted to the projections of the boot. The in-line roller skate has good floor or ground adaptability and shock-absorbing effects.

1 Claim, 6 Drawing Sheets

PRIOR ART

PRIOR ART

IN-LINE ROLLER SKATE WITH A SOLE PLATE STRUCTURE

BACKGROUND OF THE INVENTION (a) Field of the Invention

The present invention relates generally to an in-line roller skate, and more particularly to an in-line roller skate with good shock-absorbing effects and floor or ground adaptability, in which the distance between the roller mounting plates and the outer sole of the boot may be adjusted according to the floor or ground surface.

(b) Description of the Prior Art

The structure of the sole plate of a conventional in-line roller skate is shown in FIG. 1. It essentially comprises an integrally formed sole plate 1 holding a line of four rollers C1, C2, C3 and C4 in between, and a plurality of locking means 2 for securing the rollers C1, C2, C3, and C4 to the sole plate 1 in a pivotal fashion. The sole plate 1 is in turn firmly locked to an outer sole of a boot A. In actual use, if the in-line roller skate of the conventional construction is used on a ragged ground surface, the shock generated will be transmitted directly to the soles of the skater who will feel uncomfortable and tired after some time. With further reference to FIG. 2, the rollers C1, C2, C3 and C4 are pivotally connected to the integrally formed sole plate 1, and the relative position among the four rollers C1, C2, C3 and C4 is therefore fixed. If the roller C1 encounters a raised portion G1 on the ground G, the roller C1 will raise slightly so as to pass over the raised portion G1, causing the entire sole plate 1 to become lifted through a certain angle so that the rollers C2 and C3 cannot touch the ground G, affecting the safety of the skater.

SUMMARY OF THE INVENTION

According to a first aspect of the present invention, an outer sole of a boot is provided with a plurality of downwardly extending projections having slots for pivotally mounting a plurality of pairs of mounting plates, the slots accommodating therein elastic bushings for absorbing shock so as to reduce the uncomfortable feeling created when the skater plays on a rugged ground surface.

According to a second aspect of the present invention, multiple rollers are pivotally mounted in pairs of two onto two separate pairs mounting plates, each pair of mounting plates is independently mounted to a plurality of projections containing shock-absorbing bushings on an outer sole of a boot in which, when one of the rollers pass over a raised portion on the ground, the rest of the rollers may still be in contact with the ground surface, hence enhancing the safety of the skater and the floor or ground adaptability of the in-line roller skate.

BRIEF DESCRIPTION OF THE DRAWINGS

The foregoing and other features and advantages of the present invention will be more clearly understood from the following detailed description and the accompanying drawings, in which.

FIG. 4A is an enlarged view of an elastic bushing according to the invention;

DETAILED DESCRIPTION OF THE PREFERRED EMBODIMENT

Figure 1:
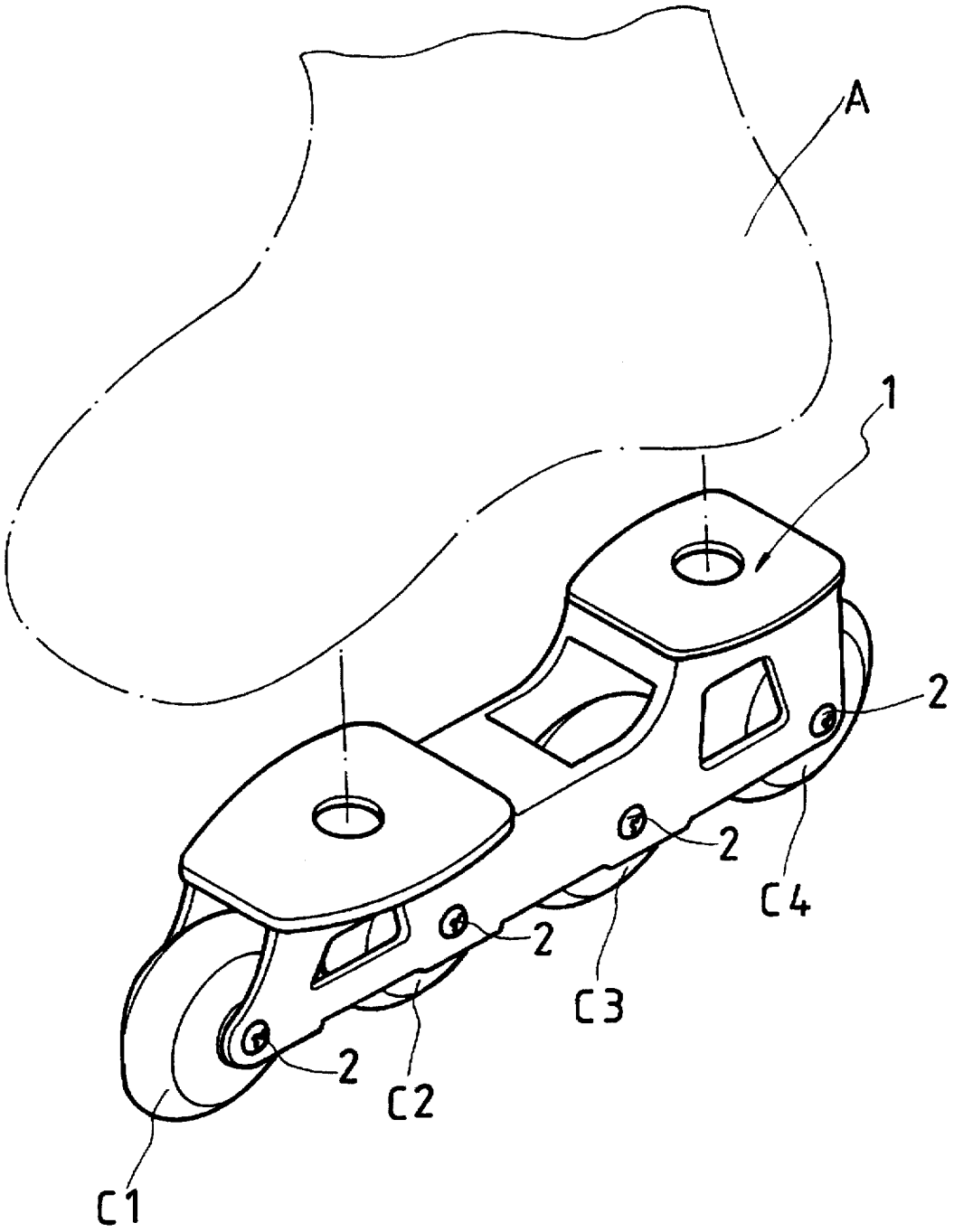
FIG. 1 is a schematic view of a sole plate structure of a conventional in-line roller skate.
Figure 2:
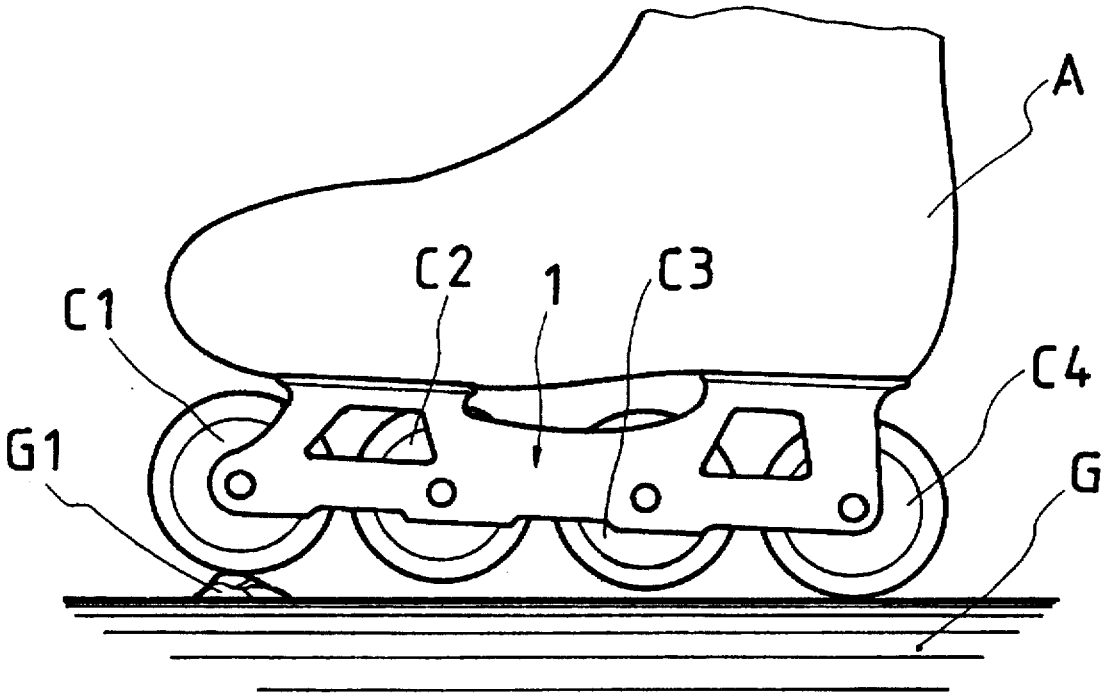
FIG. 2 is a front view of the conventional in-line roller skate in actual use.
Figure 3:
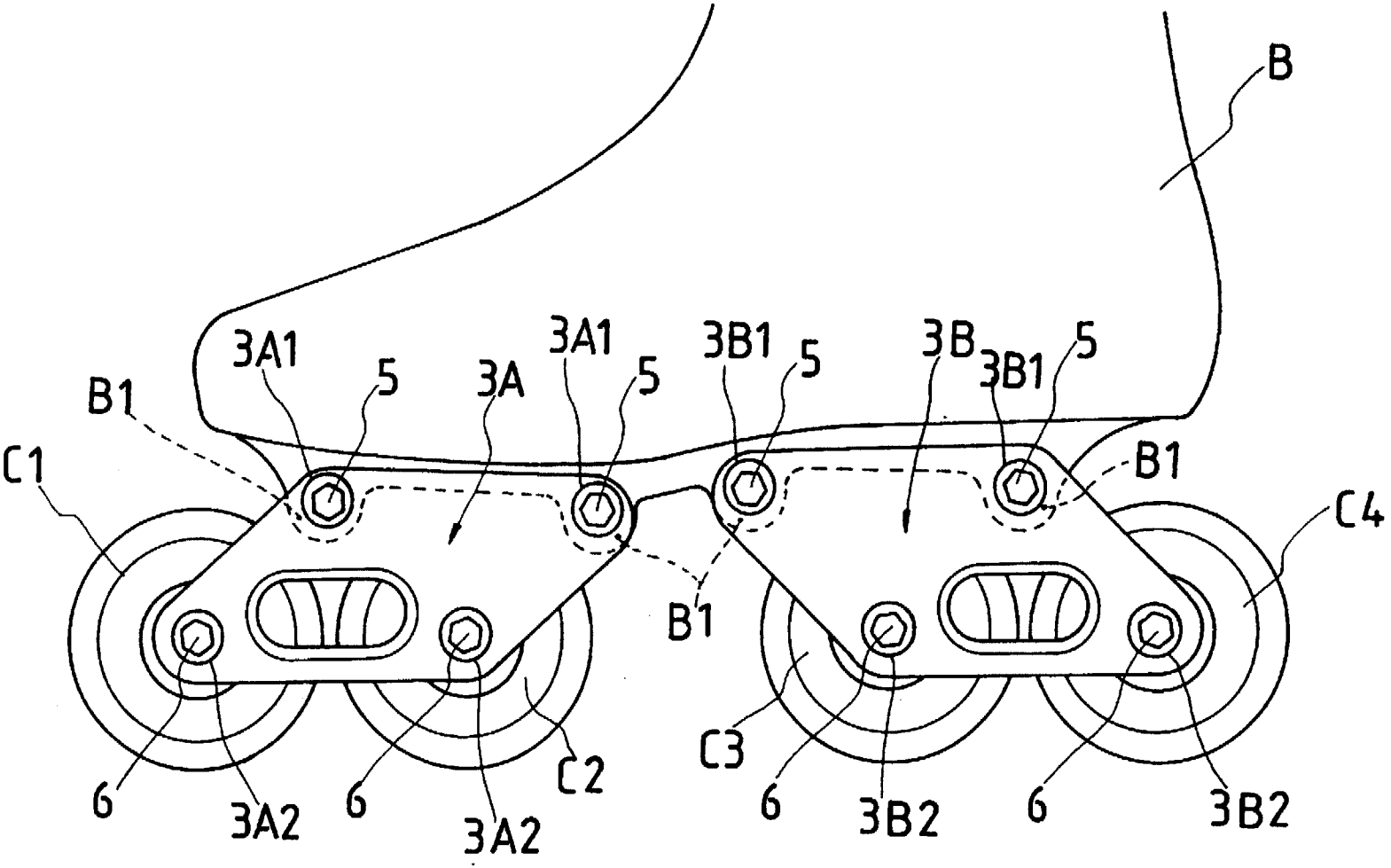
FIG. 3 is schematic view of the in-line roller skate according to the present invention.

With reference to FIG. 3, a preferred embodiment of improved sole plate structure according to the present invention essentially comprises two separate pairs of mounting plates 3A and 3B pivotally connected to a plurality of projections B1 extending downwardly from an outer sole of a boot B. Two rollers C1 and C2 are clamped between the first pair of mounting plates 3A while two rollers B1 and B2 are retained between the second pair of mounting plates 3B.

Figure 4:
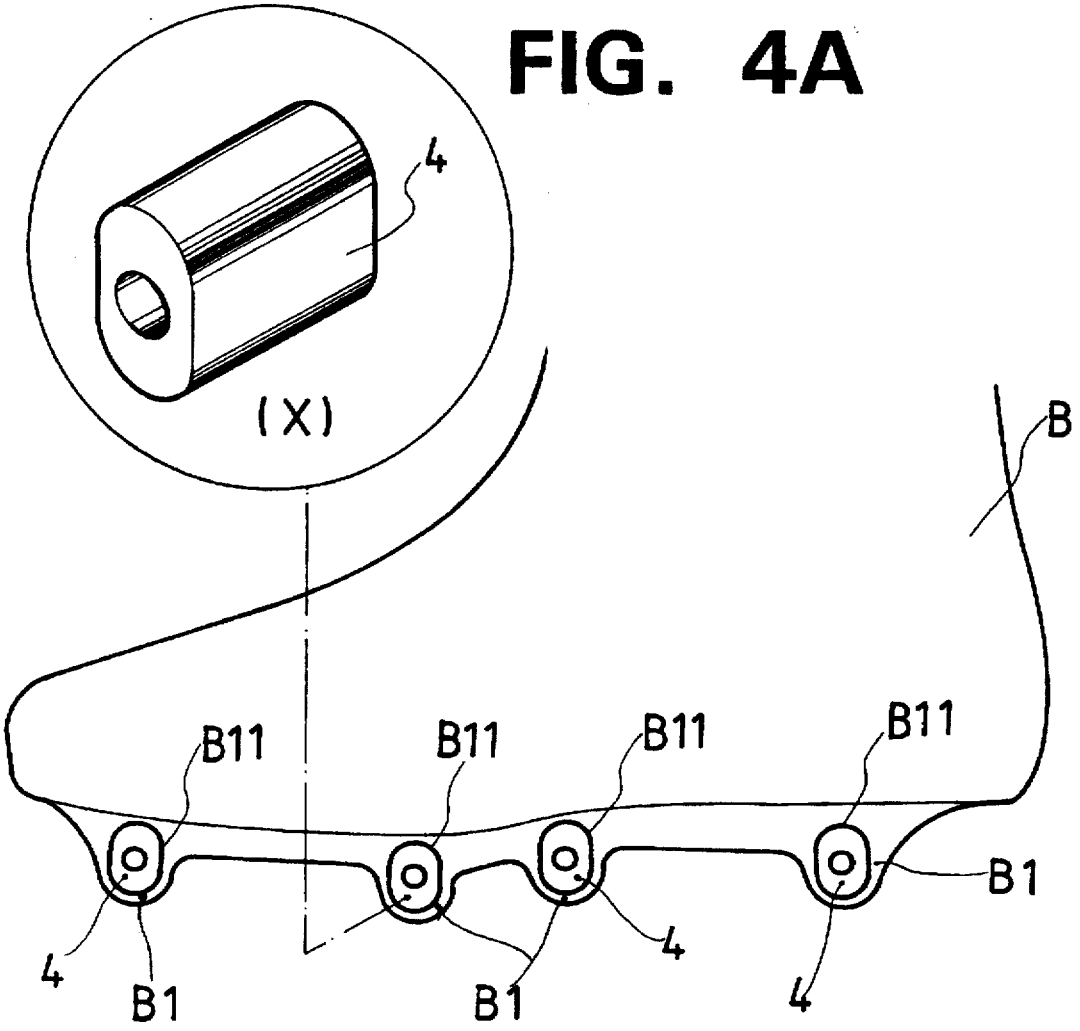
FIG. 4 is a schematic view illustrating a plurality of projections of the in-line roller skate of the invention.

The structure of the projections B1 on the outer sole of the boot B is shown in FIG. 4. Each-projection B1 which extends downwardly from the boot is internally provided with a vertical, elongated slot B11 for receiving a bushing 4 as that shown in FIG. 4A. The bushing 4 is formed of elastic plastic material for absorbing shock when the roller skate is subjected to external impact and for providing suitable elasticity or resilience. Referring to FIGS. 3 and 4, the first and second pairs of mounting plates 3A and 3B are respectively arranged on both sides of the outer sole of the boot B and are respectively provided with a plurality of pivot holes 3A1, 3B1 in their upper portions for receiving locking means 5 which pivotally connect the respective mounting plates 3A and 3B to the corresponding projections B1. Besides, the respective pairs of mounting plates 3A and 3B are provided with mounting holes 3A2 and 3B2 in their lower portion for receiving fastening means 6 which pivotally secure the rollers C1 and C2 in between the first pair of mounting plates 3A and the rollers C3, C4 in between the second pair of mounting plates 3B, in which the two pairs of mounting plates 3A and 3B are arranged to be separated from and independent of each other.

Figure 5A:
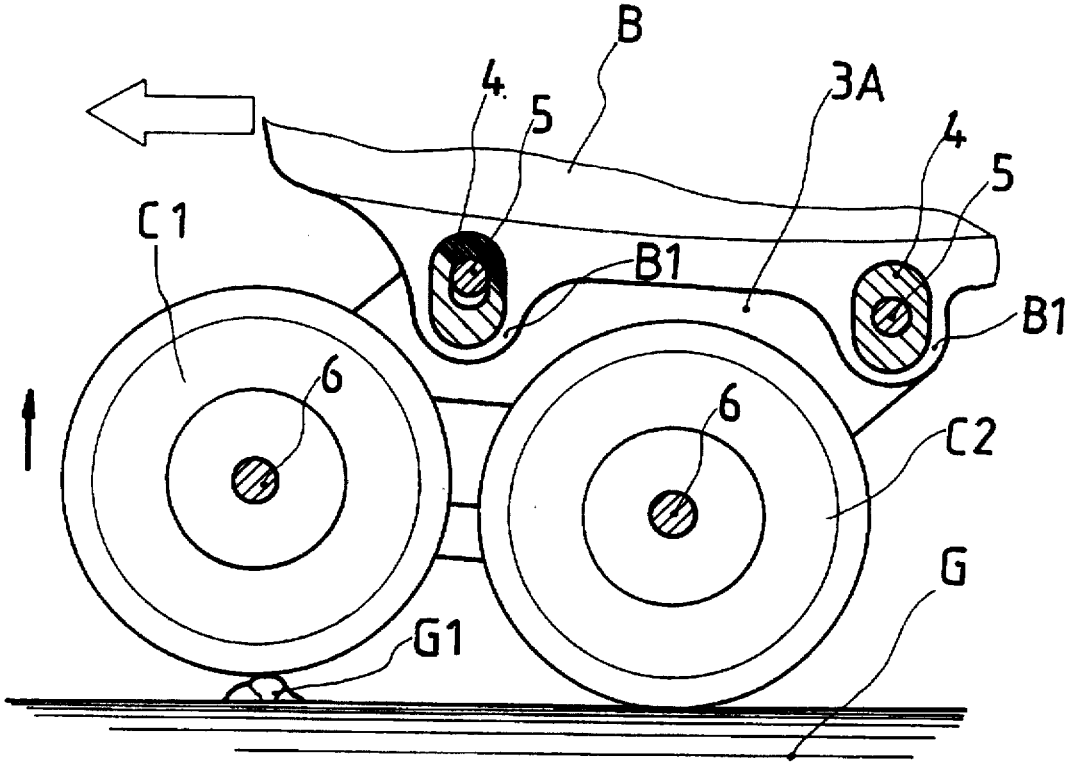
FIG. 5A is a schematic view illustrating the in-line roller skate of the invention in actual use.
Figure 5B:
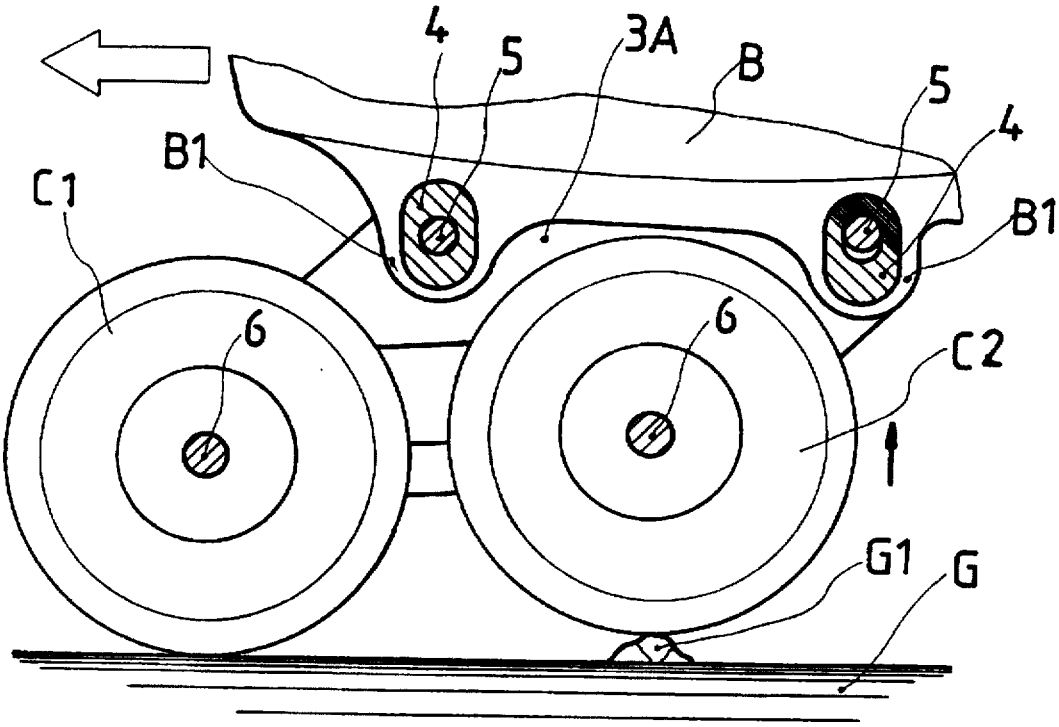
FIG. 5B is another schematic view illustrating the in-line roller skate of the invention in actual use.
Figure 6:
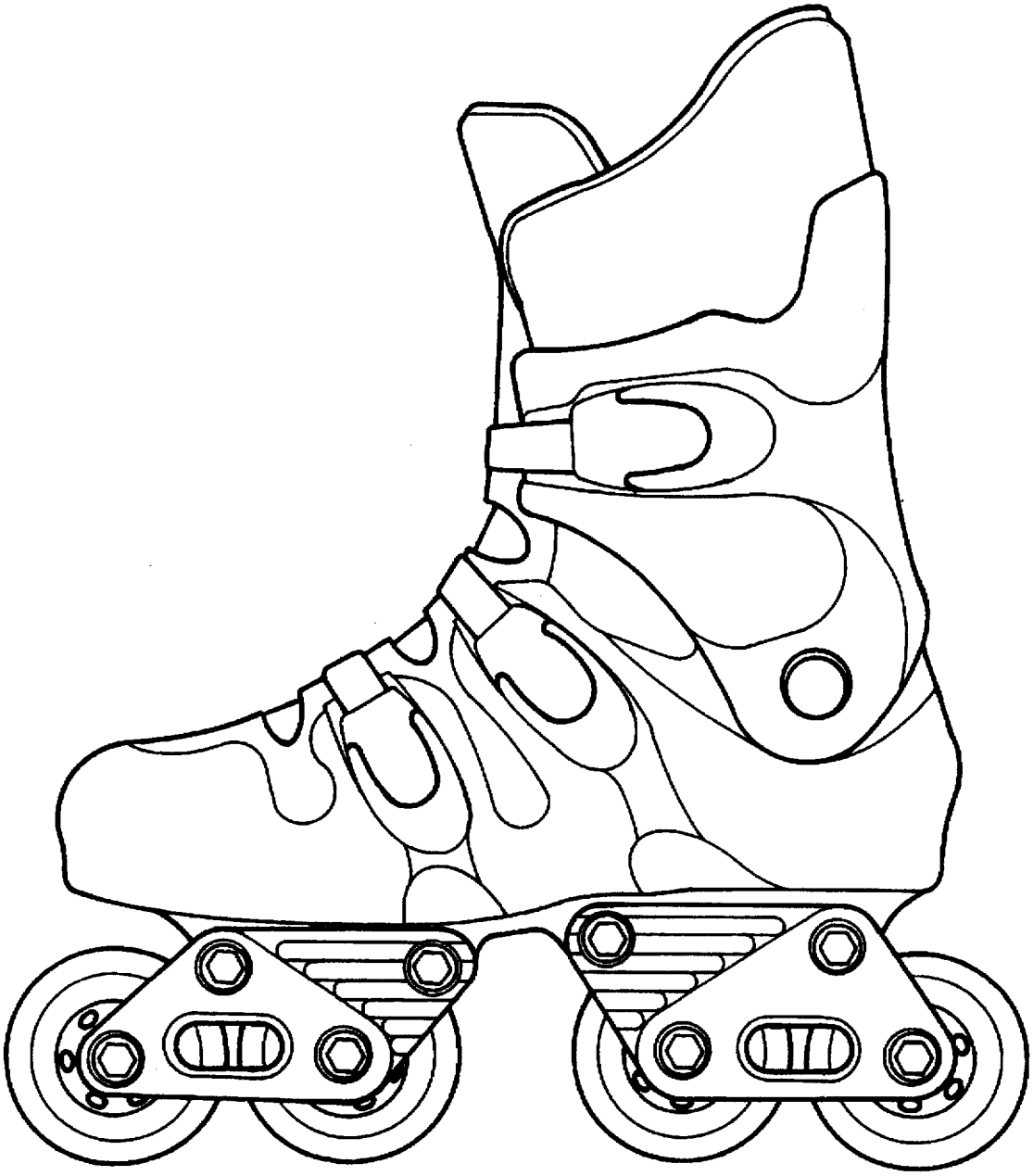
FIG. 6 is a front view of the in-line roller skate according to the invention.

Action of the in-line roller skate according to the present invention will be described with reference to FIGS. 5A and 5B which are sectional views of the first pair of mounting plates 3A, showing the inter-relationship between the mounting plates and the projections B1. In actual use, when the roller C1 hits upon a raised portion G1 on the ground G, as shown in FIG. 5A, in order that the roller C1 may smoothly pass over the raised portion G1, the action force generated upon impact with the raised portion G1 will be transmitted upwardly via the locking means 5 near the roller C1 and the bushing 4 within the projection B1 will, by means of its own elasticity, absorb the shock and become slightly flattened. On the other hand, since the shock is absorbed by the bushing 4 near the roller C1, the roller C2 will not be affected and will remain in contact with the ground G. Furthermore, when the roller C1 has smoothly passed over the raised portion G1 on the ground G, the bushing 4 near the roller C1 will return to its original shape, while another bushing 4 near the roller C2 will absorb the shock generated upon impact with the raised portion G1 and become slightly flattened so as to smoothly pass over the raised portion G1 on the ground G. Besides, since the rollers C3 and C4 on the second pair of mounting plates 3B are independently mounted to the outer sole of the boot B, they may remain close to the ground G when the rollers C1 and C2 hit upon the raised portion G1 on the ground G, hence enhancing the ground or floor adaptability and shock-absorbing effects of the in-line roller-skate.

Although the present invention has been illustrated and described with reference to the preferred embodiment thereof, it should be understood that it is in no way limited to the details of such embodiment but is capable of numerous modifications within the scope of the appended claims.

What is claimed is:

1. An in-line roller skate with improved sole plate structure, comprising:

a boot with an outer sole having a plurality of downwardly extending projections, each of said projections being provided with a vertical, elongated slot receiving a bushing made of elastic plastic material, and multiple pairs of mounting plates having two ends at an upper and lower portion for respectively clamping a plurality of rollers between each pair of said mounting plates, each of said mounting plates having two upper holes at both ends of an upper portion thereof receiving locking means which pivotally secure each of said mounting plates to the corresponding projections through said bushing on the outer sole of said boot and two lower holes at both ends of a lower portion thereof for receiving fastening means which pivotally secure the rollers to said mounting plate.

* * * * *